United States Patent [19]

Madsen

[11] Patent Number: 4,881,588

[45] Date of Patent: Nov. 21, 1989

[54] DRAPERY HANGER AND MANIPULATOR

[76] Inventor: Harold L. Madsen, 14615 S. Clark St., Dolton, Ill. 60419

[21] Appl. No.: 247,497

[22] Filed: Sep. 22, 1988

[51] Int. Cl.[4] ..... A47H 1/00

[52] U.S. Cl. ..... 160/345; 160/126

[58] Field of Search ..... 160/123–126, 160/330, 345, 346

[56] References Cited

U.S. PATENT DOCUMENTS

| | | | |
|---|---|---|---|
| 1,494,428 | 5/1924 | Kirsch . | |
| 1,662,928 | 3/1928 | Kirsch . | |
| 1,746,143 | 2/1930 | Callahan . | |
| 1,756,365 | 4/1930 | Kirsch . | |
| 2,636,556 | 4/1953 | Light et al. . | |
| 2,653,344 | 9/1953 | Graber . | |
| 3,130,775 | 4/1964 | Walker | 160/172 |
| 3,311,158 | 3/1967 | Mason et al. | 160/126 |
| 3,361,190 | 1/1968 | Snyder | 160/330 |
| 3,424,225 | 1/1969 | Magnusson | 160/345 |
| 3,430,678 | 3/1969 | Steck et al. | 160/346 |
| 3,513,900 | 5/1970 | Ronfola | 160/126 |
| 3,667,531 | 6/1972 | Wilkins | 160/345 |
| 3,844,330 | 10/1974 | Hyman | 160/166.1 |
| 3,982,581 | 9/1976 | Madsen | 160/340 |
| 4,112,995 | 9/1978 | Pasinski | 160/126 |
| 4,240,489 | 12/1980 | Madsen | 160/126 |
| 4,355,677 | 10/1982 | Madsen | 160/126 |

*Primary Examiner*—Ramon S. Britts
*Assistant Examiner*—David M. Purol
*Attorney, Agent, or Firm*—Evan D. Roberts

[57] ABSTRACT

A drapery hanger and manipulator is disclosed herein with drapery panels or segments suspended on groups of drapery hook hangers, and a series of carriers slidably actuatable along a track with inter-working structures and mechanisms driven and operated by a single linear drive.

16 Claims, 5 Drawing Sheets

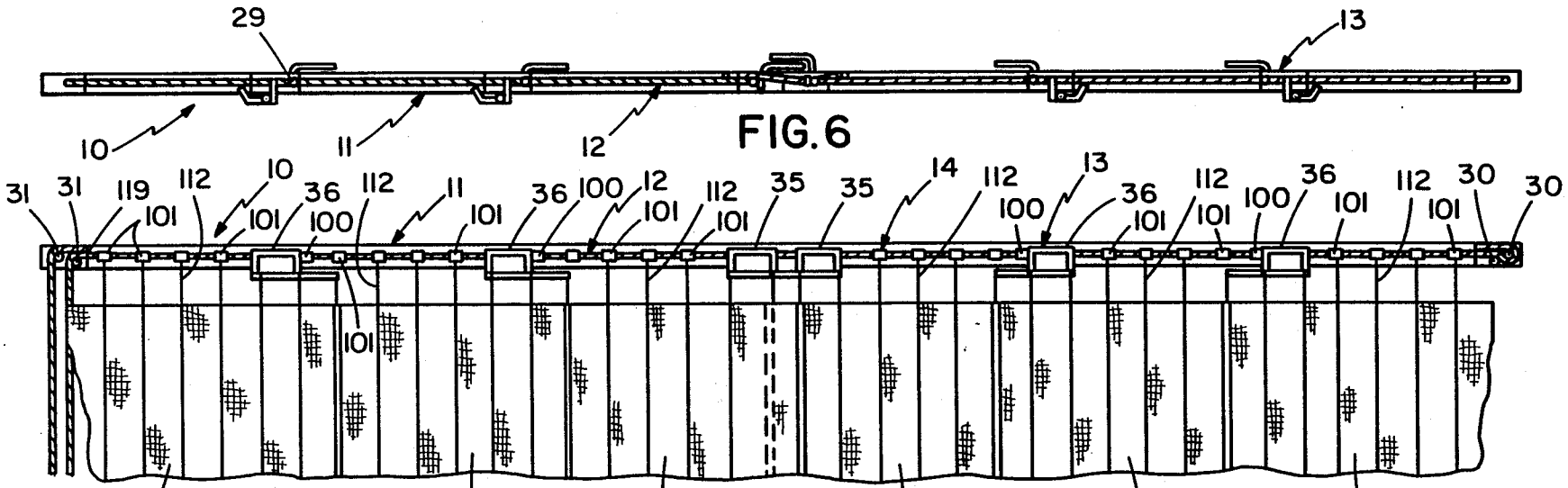
FIG.6
FIG.7
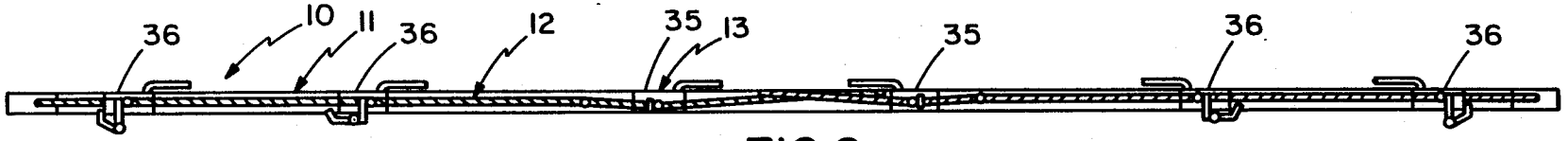
FIG.8
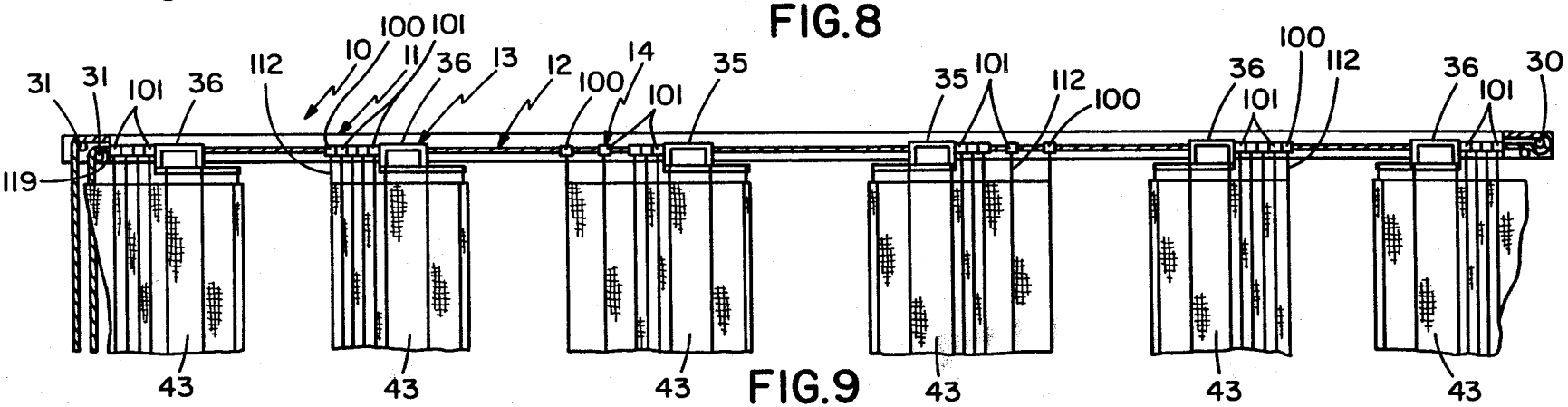
FIG.9

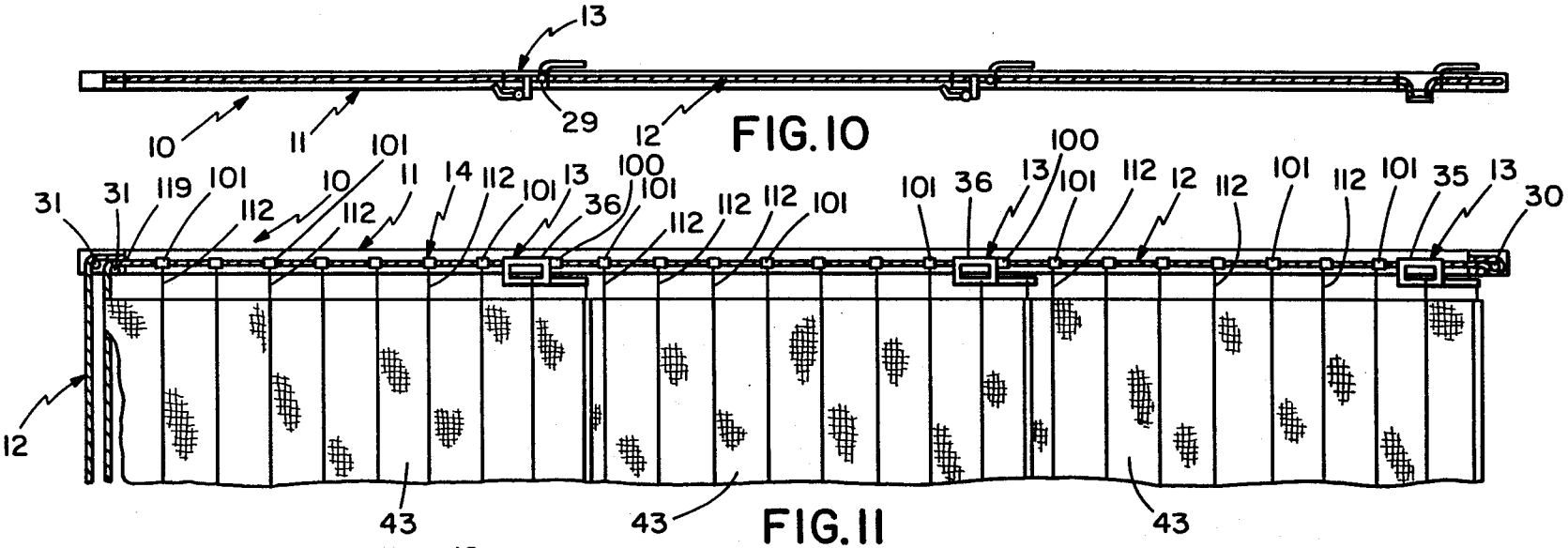
FIG. 10
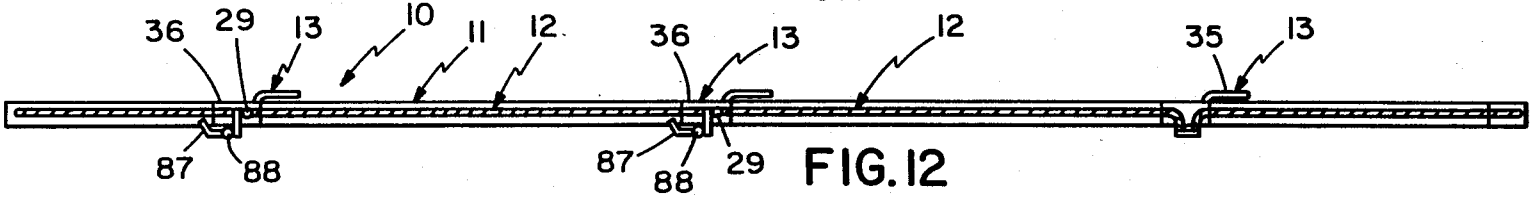
FIG. 11
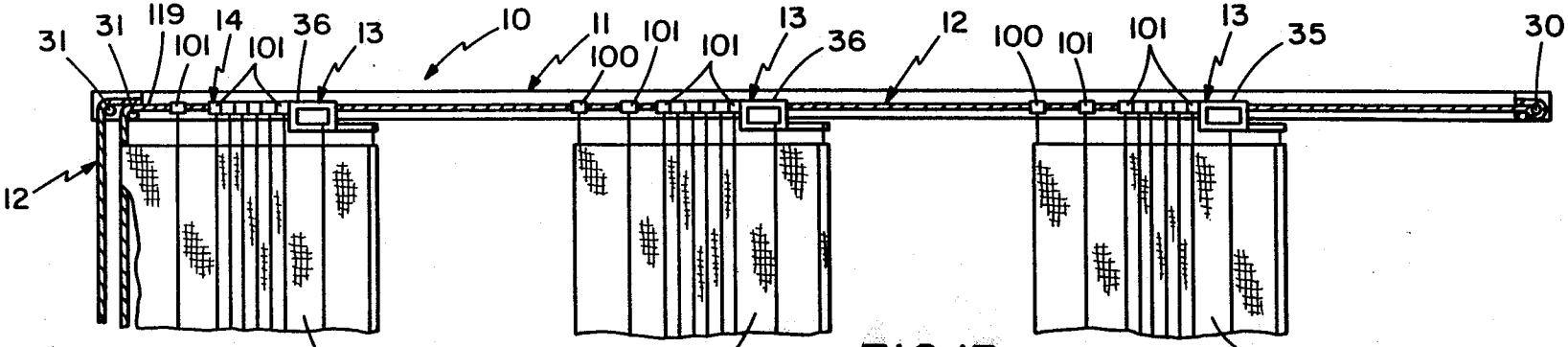
FIG. 12
FIG. 13

DRAPERY HANGER AND MANIPULATOR

SUMMARY OF THE INVENTION

This invention relates to an improvement of the inventor's improved drapery hanger represented by U.S. Pat. No. 4,355,677, and generally relates to an improved drapery hanger and manipulator for supportably hanging and selectively manipulating drapery curtains of a series of drapery curtain panels, on a conventional drapery rod track or bridge, by means of groups of drapery hook hangers and drapery carriers slidably mounted on a traverse track bridge and selectively driven and otherwise manipulated to individually spread or collapse the respective curtain panels over the area to be covered with improved manipulating means whereby the individual panels can be made to individually completely cover a given area; to be collapsed within said area to allow light to pass therebetween; to be variably positioned over said area and moved along the overall area to a selected position therealong; and all by utilizing a conventional drapery rod track or bridge.

BACKGROUND OF THE INVENTION

In the known types of drapery or curtain supporting devices, it is a common facility thereof to provide some means by which draperies or curtains can be manipulated from side to side or from top to bottom or even rotated in place over a given area to be covered by the drapes or curtains. To accomplish this, the drapery holders in known types of devices slide or otherwise merely move the drapes or curtains to and fro by pulling on one end or the other of the drapes, or to rotate the drapes about a given position, to complete, or partially complete, the closing of the opening to be covered thereby.

In Inventor's previous invention, as set forth by the above identified patent, the sequential actuation, or release or deactuation of the reverse drive mechanism for moving the drapery panels in the reverse direction, required a first track means for supporting drapery hook hangers, a second track means to support drapery carriers with serial cam means located therealong, cam followers on one or more of the carriers, and retainer means longitudinally spaced apart along the track and progressively in the linear path of the drapery hook hanger means to retain and position the hook hangers in groups along the track, none of which is required by the present invention in view of an improved structure and system thereof.

It is a general primary object of the drapery hanger and manipulator of this invention to provide an improved drapery curtain hanger and manipulator which, when operated, will provide selective positioning of independent segments of drapery curtains, over or along an area to be covered thereby, and with a selective degree of extension or collapse in either direction in addition to being selectively positionable along the opening to be affected thereby.

Further, it is an object of this invention to provide an improved drapery hanger and manipulator which is selectively operated to and fro across the drapery area and yet be selectively expandable or collapsible in any position over that area by the selective bilateral operation of a single linear drive or actuating means.

Also, it is an object of this invention to provide an improved drapery hanger and manipulator wherein the release limits of the reverse drive for the individual panels are controlled by interreaction between adjacent carriers or fixed member, without requiring cams, cam followers, stop means, and which can be used with conventional drapery tracks.

Other advantages and novel aspects of this invention will become apparent from the following detailed description, in conjunction with the accompanying drawings wherein:

FIG. 6 is a partially sectioned schematic top view of the drapery hanger of this invention showing a two-way center closing traverse track bridge with carrier trip releases in the locked positions providing a fully closed position;

FIG. 7 is a rear schematic elevation view of the drapery hanger and manipulator of this invention with the two-way center close traverse track bridge partially sectioned with the drive means and carriers in the locked positions showing drapery panels in a fully closed position;

FIG. 8 is a partially sectioned top schematic view of the improved drapery hanger and manipulator of this invention showing a two-way center close type traverse track bridge with the two lead carriers being withdrawn away from each other and from the center close position of FIGS. 6 and 7, and the remaining carriers of this invention also shown being withdrawn from a closed position;

Figure 14:
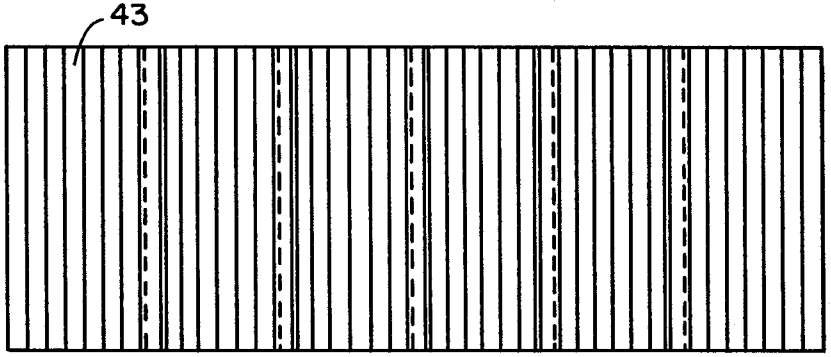
Figure 15:
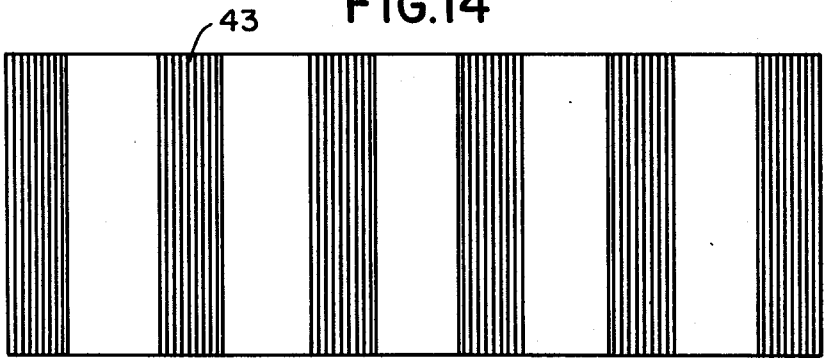
Figure 16:
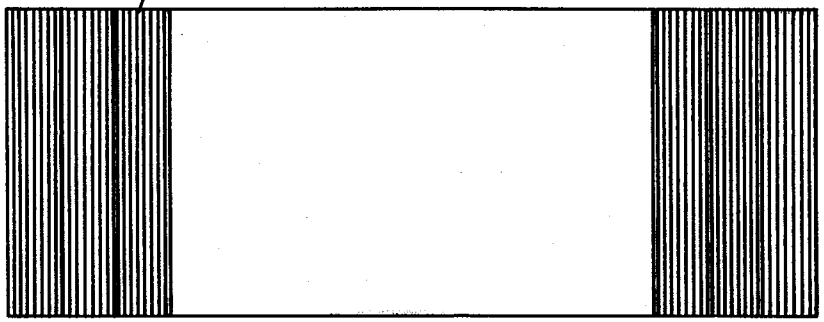
Figure 17:
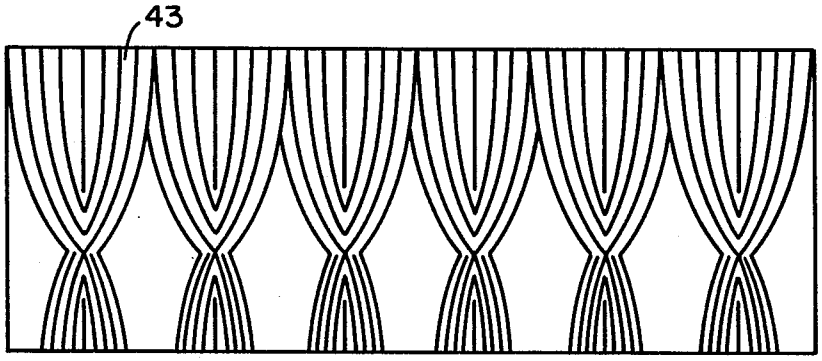
Figure 18:
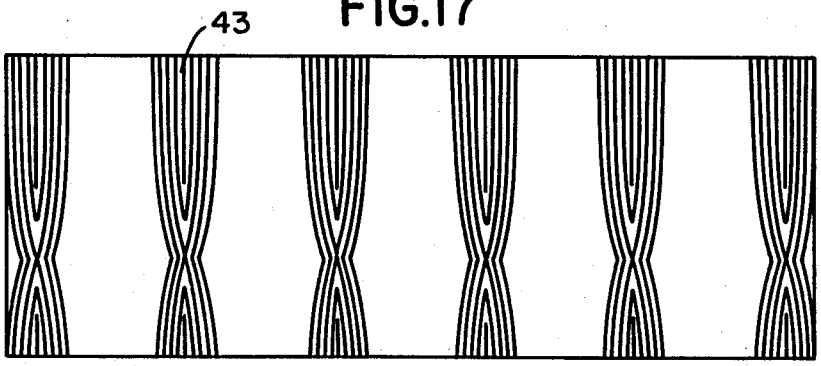
Figure 19:
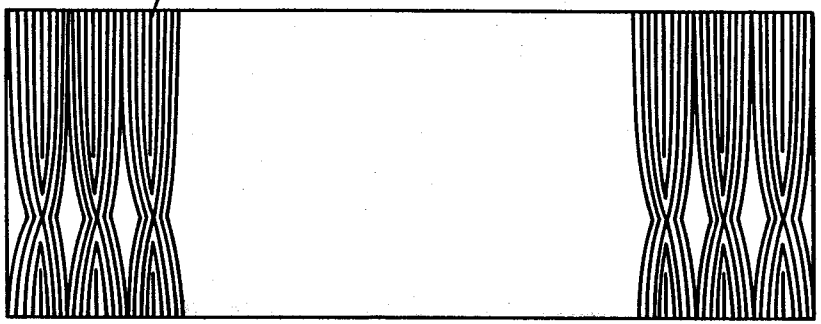

FIG. 9 is a partially sectioned rear schematic elevation view of this invention showing a two-way center close type traverse track bridge with the two lead carriers being withdrawn away from each other and from the center close position of FIGS. 6 and 7, and the remaining carriers of this invention also shown being withdrawn from a closed position along with the lead edges of drapery panels to create a series of multiple light openings along said traverse track bridge;

FIG. 10 is a partially sectioned schematic top view of this invention showing a one-way type traverse track bridge with the lead carrier and two successive equally spaced carriers actuated from the left toward the right end of traverse track bridge with carrier trip releases in the locked positions providing a fully closed position;

FIG. 11 is a partially sectioned rear schematic elevation view of the improved drapery hanger and manipulator shown in FIG. 10 showing the position of the carriers, hook hanger means, rear hook retainer means and drapery panels on said track when said drapery hanger and manipulator is in the fully closed position;

FIG. 12 is a partially sectioned schematic top view of the drapery hanger and manipulator of this invention showing a one-way type traverse track bridge with the lead carrier and two drapery carriers being reversely actuated from the fully closed position to the left toward the friction hook hangers on said track bridge to provide a partially spaced open position of the drapery hangers;

FIG. 13 is a partially sectioned rear schematic elevation view of the improved drapery hanger and manipulator shown in FIG. 12 showing the interrelated position of the improved drapery carriers, hook hanger retainer means, and drapery panels on said track bridge when said drapery hanger and manipulator is urged to the partially spaced open position to provide variably controlled multiple openings;

FIG. 14 is a front elevation view of drapery panels manipulated by this invention showing the panels in the fully closed position in a two-way center close traverse track bridge;

FIG. 15 is a front elevation view of the drapery panels shown in FIG. 14 when manipulated by this invention in a two-way center close traverse track bridge to provide partially open and spaced apart drapery panels;

FIG. 16 is a front elevation view of the drapery panels of FIGS. 14 and 15 which have been manipulated by this invention to show a fully opened drapery panel position in a two-way center close traverse track bridge;

FIG. 17 is a front elevation view of gathered drapery panels manipulated by this invention showing the panels in the fully closed position in a two-way center close traverse track bridge;

FIG. 18 is a front elevation view of the gathered panels shown in FIG. 17 when manipulated by this invention in a two-way center close traverse track bridge to provide partially closed and spaced apart gathered panels; and FIG. 19 is a front elevation view of the gathered panels of FIGS. 16 and 17 which have been manipulated by this invention to show a fully opened gathered panel position in a two-way center close traverse track bridge.

The drapery hanger and manipulator of this invention is an improvement of the drapery hanger represented by the inventor's U.S. Pat. No. 4,355,677 and is: disclosed specifically in FIGS. 1–5 hereof; generally in FIGS. 6–19; and is generally illustrated by the numeral 10. The drapery hanger and manipulator 10 of this invention includes generally, a traverse track bridge 11, linear drive means 12, drapery carrier means 13, drapery hook hanger means 14, forward and reverse drive receiving means 15 and reverse drive disengaging means 16.

Figures 1, 2, 3:
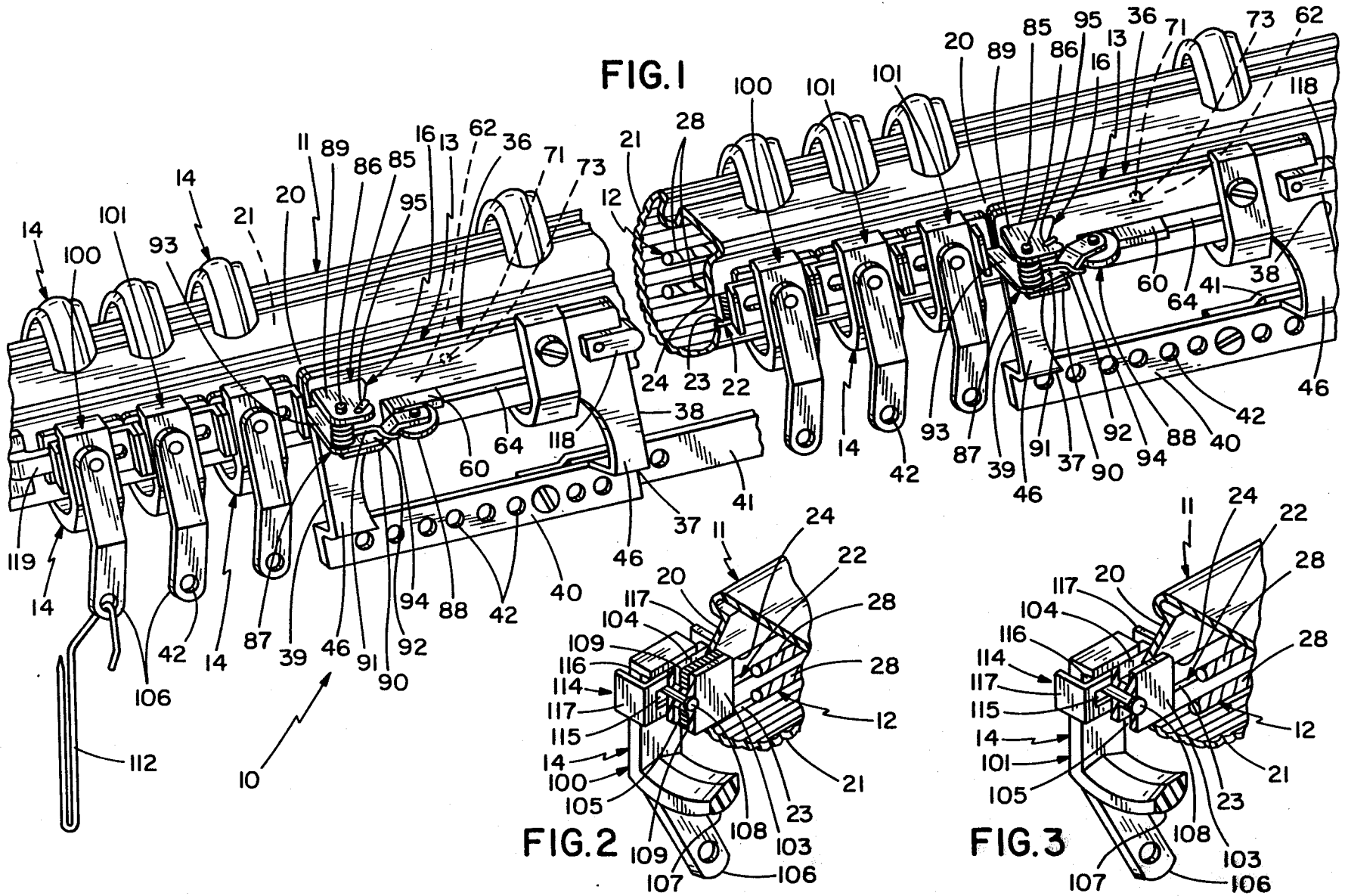
FIG. 1 is a partially cutaway partial perspective view of an embodiment of this invention showing a single traverse track bridge with a single drive means, drapery hook hangers, a drapery carrier at the right with a linear drive means in normal forward or reverse condition, and another carrier at the left with the linear drive means in the drive release condition.
FIG. 2 is a partial perspective view of a trailing end drapery hook hanger of this invention showing a release actuator link and a frictional mounting of the hanger for frictionally slidably supporting the trailing edge portion of a drapery on the traverse track bridge.
FIG. 3 is a partial perspective view of an intermediate drapery hook hanger of this invention showing a release actuator link and a slidable mounting of the hanger for slidably supporting the intermediate portion of a drapery on the traverse track bridge.

Traverse track bridge 11 (FIGS. 1–13) is typically mounted by brackets (not shown) on the wall or other structure over an area to be covered by a drapery with a back side portion 20 (FIGS. 1–3) toward a wall and a front side portion 21 (FIGS. 1–3 away from the wall. Bridge 11 includes, generally, a longitudinal track means 22 having a lower rail portion 23 and an upper rail portion 24 for supporting drapery carriers 13 and drapery hook hanger means 14.

Linear drive 12 FIGS. 1–13) includes a continuous flexible drive cord or cable 28 with progressively sized drive projections 29 (FiGS. 4–13) secured thereto at predetermined spaced apart distances along cable 28. Drive projections 29 are progressively larger in a rearward direction along bridge 11 for each set of panels. In a situation of a double-draw panel situation (FIGS. 6–8 and 14–19), drive projections are progressively larger in each of the left and right sets of panels in the direction from the center of bridge 11 and respectively toward the rearward or outer ends of bridge 11. In a single-draw set of panels (FIGS. 10–13), the same situation of progressively larger drive projections exists from the right or forward end toward the left or rearward end of bridge 11. Continuous cable 28 is threaded over pulleys 30 and 31 (FIGS. 7, 9, 11 and 13) to respectively direct cable 28 in both directions of movement, and at right angles from along bridge 11 downwardly.

Drapery carrier means 13 (FIGS. 1 and 4–13) includes lead carriers 35 and follower carriers 36 (FOGS. 6–13). Each carrier 35 and 36 is provided with a carrier frame 37 (FIGS. 1, 4 and 5) having a forward end 38 and a reverse end 39. A drapery support bracket 40 extends downwardly from each carrier frame 37. A longitudinal extension 41 is secured to bracket 40 to extend forwardly of said bracket 40. Bracket 40 and extension 41 are provided with openings 42 in a vertical portion for supporting typical drapery hooks 112. Each carrier 35 and 36 is thus provided with means to respectively support the leading portion of respective drapery panels 43 (FIGS. 6, 8, 11 and 13–19).

Each carrier frame 37 (FIGS. 1, 3 and 4) is further provided with parallel longitudinal lower and upper grooves 44 and 45 for respectively receiving lower and upper rails 23 and 24 of track bridge 11 to slidably support respective carriers 35 and 36 in track bridge 11 with frame back portion 46 facing the same direction as track bridge back portion 20, and frame front portion 47 facing the same direction as track bridge front portion 21.

Generally in a single-draw drapery situation (FIGS. 10–13), where it is desired to have one series of drapery panels 43 moved from one end of track 22 toward the other end of track bridge 11, leading carrier 35 is secured to cable 28. When cable 28 is moved in one direction, lead carrier 35 and follower carriers 36 will be urged away from one end of bridge 11. When cable 28 is moved in the opposite direction, lead carrier 35 and follower carriers 36 will be urged toward the other end of bridge 11.

In a double-draw drapery situation (FIGS. 6–8 and 14–19), where it is desired to have two sets of drapery panels 43 and each set of drapery panels 43 is to be simultaneously moved in opposite directions toward and away from the center of track bridge 11, center leading carriers 35 are respectively secured to oppositely moving portions of continuous cable 28. When cable 28 is moved in one direction, lead carriers 35 will be moved away from the center of bridge 11, and when cable 28 is moved in the opposite direction, lead carriers 35 will be urged toward the center of bridge 11.

Drive receiving means 15 is provided on each follower carrier 36 (FIGS. 4 and 5) and includes, generally, longitudinally aligned forward and rearward cable guide openings 52 and 53 in respective forward leading and rearward trailing plate portions 54 and 55 of drive receiver 15. A reverse drive block 56 is slidably mounted in a longitudinal rectangular cavity 57 of drive receiver 15, and has a longitudinal passage 58 therethrough to allow free passage of drive cord 28 and drive projections 29.

Figure 5:
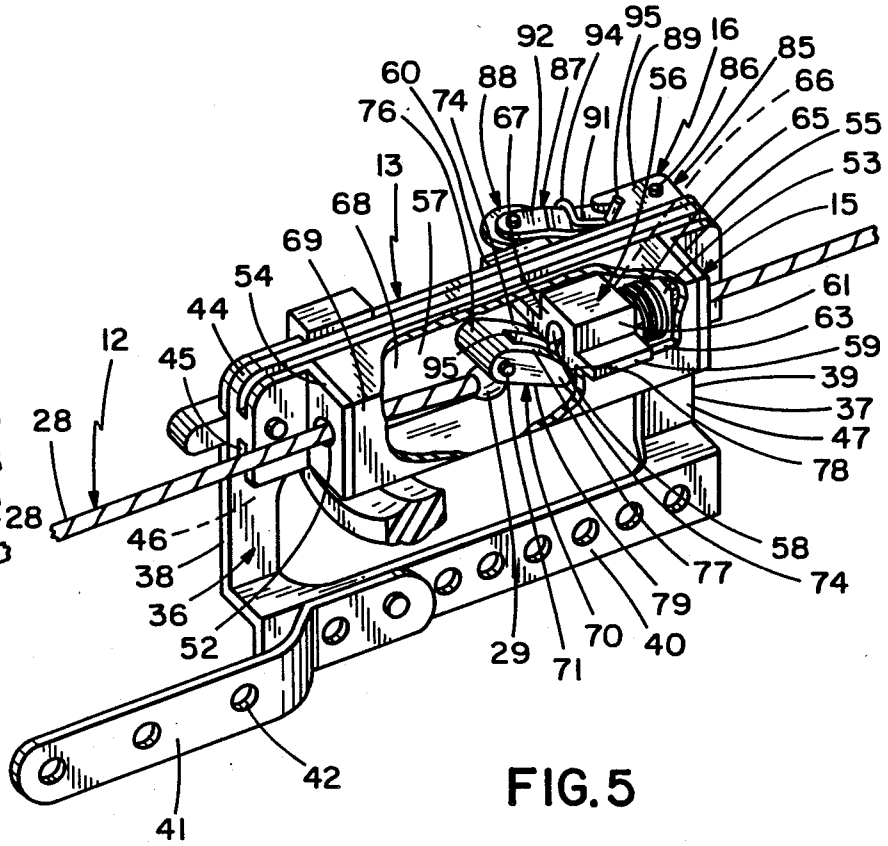
FIG. 5 is a perspective view of a drapery carrier of this invention, as seen from the side opposite that of left carrier of FIG. 1, showing a linear drive in the reverse releasing condition.
Figure 4:
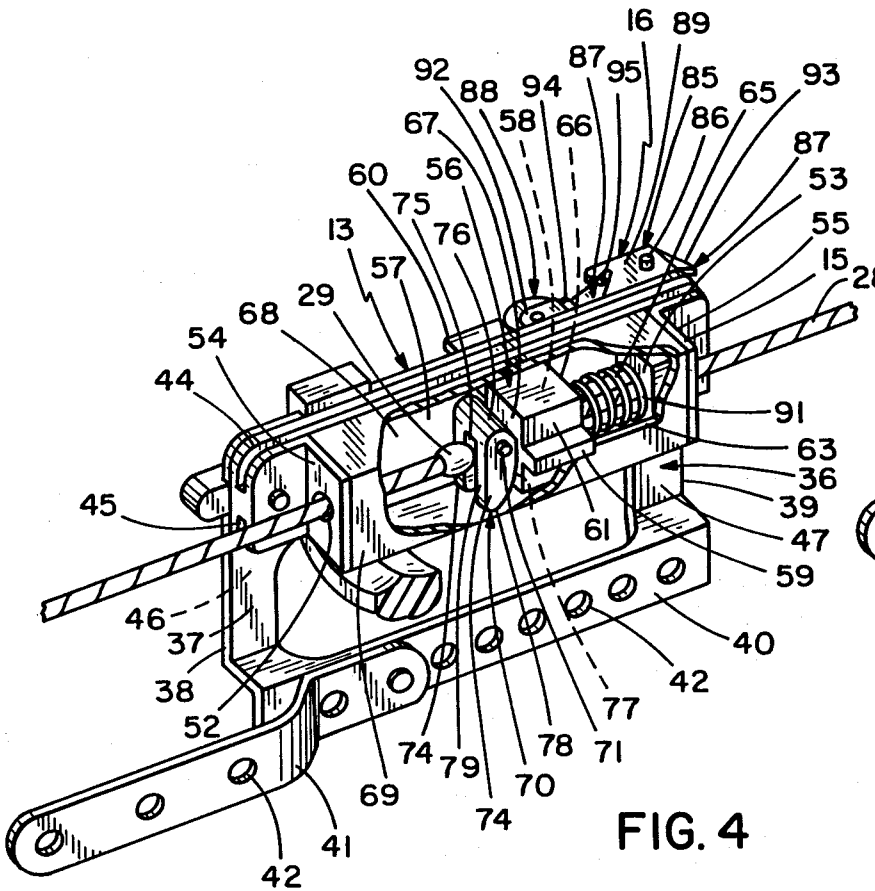
FIG. 4 is a perspective view of a drapery carrier of this invention, as seen from the side opposite that of FIG. 1, showing a linear drive therethrough, and a drapery carrier drivingly connected with the linear drive means for drive in either direction on the traverse track bridge.

Drive projection elements 29 of drive cable 28 are progressively larger in a direction from the center or forward portion of bridge 11, to the left or rearward portion of bridge 11 FIG. 1 or right (FIGS. 4 and 5). Eyelet openings 52 of corresponding series of carriers 13 are similarly respectively larger in the same direction.

Whereby, when series projections 29 of drive cable 28 of drive 12 are urged through eyelet openings 52 of carriers 13 of series of carriers 13 from the rearward end of bridge 11 toward the forward portion thereof, the forward smaller drive projection elements 29 will pass through the larger eyelet openings 52 of rearwardly positioned carriers 13 of series of carriers 13.

However, respective serial drive projection elements 29 will not pass through the respective smaller eyelet opening 52 of corresponding respective carrier 13 of series of carriers 13, and will thereby tend to urge the respective corresponding carrier 13 in a direction of linear movement forwardly along bridge 11 by said engagement.

Similarly, subsequently rearward drive projection elements 29 will pass through the eyelet openings 52 of the other rearwardly positioned carriers 13 without engaging same, but will engage the respective eyelet openings 52 of respective corresponding carriers 13 to sequentially drive the respective carriers successively lineally along bridge 11 from the rearward portion toward the forward or center portion thereof, to the right (FIG. 1 or left (FIGS. 4 and 5 . Largest drive projection element 29 will thereby engage its respective eyelet opening 52 of corresponding respective carrier 13, whereby linear movement of cable sections 28 toward the center, or forward, portion of bridge 11 will similarly respectively normally sequentially urge corresponding respective carriers 13 in the same direction.

Reverse drive block 56 (FIGS. 4 and 5) has front flange 59 and back flange 60 on the respective front and back sides 61 and 62 (not shown) thereof by which reverse drive block 56 is slidably mounted in front slot 63 (FIGS. 4 and 5) and back slot 64 (FIG. 1) of drive receiver 15 to control and limit the movement of reverse drive block 56 to longitudinal movement within drive cavity 57 of receiver 15. A coil spring 65 (FIGS. 4 and 5) is mounted between rear trailing surface 66 of drive block 56, and rear portion 55 of drive receiver 15 to normally urge drive block 56 forwardly (to the left in FIGS. 4 and 5 and to the right FIG. 1). Reverse drive block 56 has a front leading surface 67 to react with a reverse drive forked member 70.

Reverse drive forked member 70 is provided in each follower carrier 36 (FIGS. 4 and 5) and has a pivot pin 71 therethrough with one end thereof pivotally secured in opening 73 (not shown) of back wall 68 of drive receiver 15 (FIG. 1). The other end of pivot pin 71 is pivotally secured in a similar opening 73 also (not shown) in front wall 69 of drive receiver 15. Fork member 70 is thereby pivotally supported between walls 68 and 69, of drive receiver 15, between a normally downward locked position in the path of cable 28 (FIG. 4) and an upper unlocked releasing position generally out of the path of cable 28 (FIG. 5) and drive projections 29 thereof.

Each reverse drive fork 70 (FIGS. 4 and 5) has two tines 74 which, by the weight thereof, normally urge fork 70 pivotally downwardly about pins 71 thereof to a normal vertical down position (FIG. 4). Tines 74 form a space passage opening 75 therebetween, normally in the path of cable 28 and drive projections thereon, which space passage 75 has a lateral dimension that allows cable 28, but not a respective projection 29, to pass therebetween.

Each fork member 70 has a rounded lateral top surface 76 extending into a rearward flat lateral medial surface 77 on its trailing side. Flat lateral medial surface 77 extends downwardly into a lateral curved lower cam surface 78. Each fork 70 has a forward flat plane surface 79 extending between respective top surface 76 and cam surface 78. Rearward fork surfaces 76, 77 and 78 are adapted to react with leading surface 67 of drive block 56 (FIGS. 4 and 5). Forward surface of forks 70 is adapted to react with a selected one of progressively sized drive projections 29 of cord 28 (FIGS. 4 and 5).

Drive projections 29 (FIGS. 4–13) are progressively sized but are all small enough to pass through rear opening 53 of each drive receiving member 15 (FIGS. 4 and 5) and passage 58 of reverse drive block 56 (FIG. 5). However, fork 70 being pivotally mounted as set forth above is, by gravity, normally positioned in the path of drive cable 28 with a discriminating passage opening 75 therethrough allowing passage of cable 28, but not passage of respective selective progressively sized drive projection 29 therethrough.

When fork link 70 is in the normal gravitated vertical position (FIG. 4 , the rearward movement of a respective progressively sized drive projection 29 of cable 28 is blocked by link tines 74 of a respective fork 70, held in blocking position by block 56. When fork 70 is in the upper position (FIG. 5), fork 70 will allow passage of all drive projections 29, as well as cable 28.

Reverse drive disengaging means 16 is provided on follower carriers 36 (FIGS. 1, 4 and 5). Reverse drive disengaging means 16 either: retains fork link 70 in the gravitated position (FIG. 4 to allow respectively sized drive projections 29 of drive cord 28 to engage respective fork links 70 for reverse drive movement of respective follower carrier 36; or, allows fork link 70 to pivot to the upper position (FIG. 5) to release respective drive projection 29 of drive cord 28 from the reverse drive situation.

Reverse drive disengaging means 16 (FIGS. 1, 4 and 5) includes generally a pivot frame 85 secured to back side 46 of follower carrier frame 37, pivot pin 86, release arm 87 (FIG. 1 left and FIGS. 4 and 5, spring bias 91 and roller 88. Pivot frame 85 consists of upper and lower pivot supports 89 and 90 with pivot pin 86 secured therebetween and coil biasing spring 91 and release arm 87, pivotally retained thereon. Release arm 87 is generally L-shaped and has a forward release roller arm portion 92 extending generally forwardly from pivot pin 86 and a rearward actuating arm portion 93 extending generally laterally from pivot pin 86 toward bridge 11.

Coil spring 91 has an arm end 94 secured to roller arm portion 92, and a frame end 95 secured to upper pivot support 89 of frame 85, whereby release arm 87 is normally pivotally biased to the locking position shown in FIG. 1 (right side) and in FIG. 4. Roller 88 is thus normally urged into position in the rearward path of back flange 60 of drive block 56 to normally retain drive block 56 forwardly against fork 70 (FIG. 4). This normally retains follower carrier 36 in the reverse drive position with fork 70 in the path of respective drive projections 29 of cable 28.

If rear actuator arm portion 93 of release arm 87 is urged forwardly toward pivot frame 85, release roller arm portion 92 of release arm 87 will be urged away from follower carrier frame 37 against the bias of spring 91, moving roller 88 out of the path of drive block rear flange 60. This action will release reverse drive block 56 to move rearwardly in slots 63 and 64 of drive receiver 15 against the compression bias of spring 65 to allow fork 70 to pivot upwardly to the release position (FIG. 5).

In turn, projection 29, of drive cord 28 of drive receiver 15 is released from fork 70 to pass through follower carrier 36 by passing through reverse drive block 56, coil spring 65 and openings 53 of drive receiver 15. This allows drive cable 28 to proceed through the released follower carrier 36 and allow subsequent follower carriers 36 to be moved by drive projection 29 of drive cable 28 until similarly released. Reverse drive disengaging means 15 is thus released by engagement of actuator arm 93, of release arm 87, with any restraint in the rearward path thereof, such as carrier actuator 118 or bridge actuator stop 119 (FIG. 1 left).

Drapery hangers 14 include a trailing hook hanger 100 (FIGS. 1–3, 7, 9, 11 and 13) and intermediate or leading hook hangers 101 for every drapery panel 43. Trailing hanger 100 supports the trailing portion of drapery panel 43. Lead hangers 101, with a respective carrier 13, support the remaining and leading portion of a drapery panel 43. Each hanger 14 is provided with a rail support body 103 having an upper groove 104 and a lower groove 105 adapted to respectively receive upper and lower rail portions 23 and 24 of bridge track 22 to slidably retain each hanger in bridge 11.

Each hanger 14 is provided with a drapery panel support hanger portion 106 secured to a C-shaped hanger body 107 positioned partially around bridge 11. Hanger body 107 is secured to rail support body 103 by a pin 108. Each trailing hanger rail support body 103 is provided with frictional material 109 (FIG. 2) in upper and lower grooves 104 and 105 thereof. Trailing hanger frictional material 109 engages bridge track 22 to frictionally tend to resist movement of trailing hanger 100 in bridge track 22.

Trailing hanger 100 will move in bridge track 22 when the frictional resistance of frictional material 109 is overcome by the engaging force movement of adjaacent intermediate hangers 101, or carrier 36 moving in the bridge track 22 against a hanger 100. Leading or intermediate hangers 101 are not provided with friction resisting material 109 provided in trailing hangers 100, therefore, leading or intermediate hangers 101 freely move in the bridge channel, whereas frictional trailing hangers 100 do not. Drapery hooks 112 (FIGS. 1 and 6–13) are typically hooked into drapery panels 43 and inserted in openings 42 of respective carriers 13 and hangers 14 (FIG. 1) to support panels 43 from bridge 11

A U-shaped release link 114 is slidably retained in each hanger 14 between hanger body 107 and rail support body 103 by pin 108 extending through a slide opening 115 in release link 114 and secured to hanger body 103. Release link 114, in turn, is slidably mounted in slot 116 of hanger body 107. Release link 114 is, thereby, normally free to move on pin 108 in slot 116 between a position rearwardly of its hanger 14 (right FIG. 1) or to a position forwardly of its hanger 14 left FIG. 1).

Legs 117 of U-shaped release link 114 are adapted to engage legs 117 of adjacent release links 114. The movement of one release link 114 in engagement with an adjacent release link 114 will, thereby, urge the adjacent release link 114 to move similarly therewith and relative to the respective body 103 and hanger body 107 thereof.

Also, it should be noted that each follower carrier 36 is provided with an actuator 118 adapted to engage a leg 117 of an adjacent release link 114 of an adjacent trailing hanger 14. Similarly the rearmost portion of carrier bridge 11 (FIG. 1) is provided with an actuator stop 119 likewise adapted to engage the rearmost leg 117 of release link 114 of the rearmost trailing hanger 100. Further, upon rearward movement against carrier actuator 18 or bridge actuator stop 119 by trailing hanger 100, release link 114 will cause a chain engagement reaction of links 114 of intermediate hangers 101 to activate actuator arm 93 thereby releasing drive projection 29 of follower carrier 36 (left FIG. 1).

The operation of the drapery hanger and manipulator of this invention will be explained with respect to a single-draw drapery situation (FIGS. 10–13). The double-draw drapery situation (FIGS. 6–8) differs from the single-draw drapery situation in that there are two sets of draperies moved in opposite directions from the center of bridge to the outer ends of the bridge. In the double-draw drapery situation, lead carriers 35 of respective left and right sets of panels are respectively secured to oppositely moving portions of drive cable whereby respective lead carriers will be moved in opposite directions as drive cable 28 is moved.

In particular, with reference to the single-draw drapery situation (FIGS. 10–13) the drapery hanger and manipulator 10 of this invention is best understood by considering the manipulator to be in the closed position (FIGS. 10 and 11) with lead carrier 35 moved to its desired right-most forward position with follower carriers 36 spaced rearwardly thereof with carriers 35 and 36 controlling drapery panels 43.

To initiate opening of the drapery panels of the closed position (FIGS. 10 and 11), cord 28 of linear drive 12 is moved over pulleys 31 such that the portion of cord 28 secured to lead carrier 35 and positioned through forward and reversed drive receiving member 15 of follower carriers 36 will be urged rearwardly [to the left (FIGS. 12 and 13)]. Drive projections 29 positioned within respective follower carriers 36 will be in engagement with flat front surfaces 79 of respective fork members 70 in the vertical reverse drive condition (FIG. 4).

As cord 28 is moved rearwardly [to the right (FIG. 4)], reverse drive disengaging means 16 will preclude lock 56 of reverse drive receiving means 15 from moving relative to fork 70, and accordingly, fork 70 and the respective follower carriers 36 thereof will be moved with drive projection 29 of cord 28 as the cord is moved in such rearward fashion.

Inasmuch as trailing hangers 100 are provided with frictional resistance 109 to movement along bridge 11, trailing hangers 100 will tend to remain stationary as carriers 13 are moved rearwardly along bridge 11. This will cause the collecting of hangers 101 in serial engaging fashion as panels 43 are collapsed rearwardly without moving frictionally retained trailing hangers 100 (FIG. 13).

As carriers 35 and 36 are thus moved rearwardly (to the left in FIGS. 1, 12 and 13), carriers 35 and 36 will respectively engage the next rearwardly positioned hanger 101. Continued rearward movement will cause hangers 101 to be rearwardly collected (FIG. 13) in the rearward path of carriers 35 and 36, collapsing panels 43 toward respective trailing hangers 100 of panels 43 creating multiple light openings along tract bridge 11.

Any further rearward or opening movement by carriers 35 and 36 would cause the complete serial collection of hangers 14 into engagement with stationary bridge stop 119 and carrier actuators 118 thus actuating release links 114 of hook hangers 14 and the reverse drive means 16, to release projections 29 of drive cord 28 for the complete serial withdrawal of carriers 35 and 36 with drapery panels 43 to a full open drapery panel position (FIGS. 16 and 19).

Thus, the drapery hanger and manipulator of this invention can be operated to provide a partially spaced open position of multiple drapery panels 43 (FIG. 13) to whatever degree desired from: a position of fully closed (FIG. 11 ; to an intermediate partially spaced open position (FIG. 13 ; to a fully spaced open position of panels 43 (FIG. 16).

It is to be understood that the invention is not to be limited to the specific constructions and arrangements shown and described, as it will be understood to those skilled in the art that certain changes may be made without departing from the principles of the invention.

What is claimed is:

1. An improved drapery hanger and manipulator for supportably hanging and manipulating one or more drapery curtain panels having a leading and a trailing edge portion comprising a single track traverse track bridge to be positioned over an area to be covered by the drapery curtain panels, drapery hook hanger means, said bridge having a track means therealong slidably supporting said drapery hook hanger means, drapery carriers serially slidably supported in said bridge track having independent movement along said bridge and supporting leading portions of respective drapery panels, drapery hook hanger means slidably supported in said bridge track means and supporting drapery hook means slidably along said bridge supporting the drapery panels from the leading to the trailing edge thereof, said drapery hook hanger means supporting the trailing edge of said panels having frictional mounting means frictionally slidably supporting said trailing edge drapery hook hanger means in said bridge track normally retaining and resisting rearward movement of said panel trailing edge, a linear drive means having forward and reverse drive means selectively providing forward and reverse linear drive along said bridge, said carriers having forward drive receiving means for sequentially receiving forward drive from said linear drive means for respectively moving said panels by urging the leading edge thereof along said bridge in a direction away from the trailing edge thereof, said carriers having a releasable reverse drive receiving means for disconnectably and respectively receiving said reverse drive means to normally respectively drive said carriers in a reverse direction along said bridge for respectively moving said panels by urging the leading edge along said bridge in a direction toward the trailing edge thereof for collapsing said panels toward the respective trailing edge thereof and moving said panels in the reverse direction, a reverse drive disengaging means as part of one or more of said carriers and adapted for normally releasably engaging and retaining said carrier thereof to said drive, said reverse drive disengaging means having a release means adapted for responding to contact with the next adjacent object in the reverse direction releasably disengaging said carrier thereof from said drive, whereby said carriers can be driven in the forward direction by said forward drive means to sequentially position drapery curtain panels over a given drapery area, and in the reverse direction by said reverse drive means respectively toward and against the frictional retention of said trailing hook hanger means to individually respectively collapse said panels toward said frictionally positioned retainers or to withdraw said panels from the given area by continuous reverse movement to provide respective separate light openings for each panel or to selectively completely remove or collapse said panels from the given area.

2. An improved drapery hanger and manipulator as defined in claim 1 wherein, a continuous loop of cord axially movably mounted to said bridge with two sections thereof positioned to move parallelly and longitudinally within said bridge in opposite directions, and said forward and reverse drive means being a series of annular lateral projections for each line section, and said annular lateral projections of each series being progressively larger in the forward movement direction of said line and being selectively spaced apart along said section, said carrier forward drive receiving means comprises a drive plate located on each of said carriers in the path of said forward drive means and having respectively progressively smaller openings therethrough in the forward direction of movement whereby forward movement of said linear drive through said openings will cause said progressively large annular projections to sequentially and respectively engage said drive plates of respective carriers at the openings thereof to similarly sequentially and respectively drive said carriers forwardly.

3. An improved drapery hanger and manipulator as defined in claim 2 wherein said carrier reverse drive receiving means comprises a series of reverse drive forked members respectively mounted on said carriers and movable to position the tines thereof into the path of said annular lateral drive members to normally receive reverse drive therefrom, and a series of reverse drive blocks respectively slidably mounted in said carriers and releasably biased into engagement with respective ones of said reverse drive forked members in the reverse path of said drive normally releasably retaining said drive blocks against said respective forked projections releasably normally retaining said reverse drive forked members in reverse drive receiving position, whereby said forked members are normally biased into the reverse path of said annular drive projections to releasably receive reverse drive engagement therefrom.

4. An improved drapery hanger and manipulator as defined in claim 2 wherein said carrier reverse drive receiving means comprises a series of reverse drive forked members respectively mounted on said carriers and movably to position the tines thereof into the path of said annular lateral drive members to normally receive reverse drive therefrom, and a series of reverse drive blocks respectively slidably mounted in said carriers and releasably biased into engagement with respective ones of said reverse drive forked members in the reverse path of said drive normally releasably retaining said drive blocks against said respective forked projections releasably normally retaining said reverse drive forked members in reverse drive receiving position, whereby said forked members are normally biased into the reverse path of said annular drive projections to releasably receive reverse drive engagement therefrom.

5. An improved drapery hanger and manipulator as defined in claim 2 wherein said reverse drive disengaging release means comprises a release lever respectively pivotally mounted on respective carriers on the reverse side thereof and in the path of the respective next adjacent drapery hanger, said release lever being pivotally biased into the reverse path of respective reverse drive of respective carriers normally precluding reverse relative movement between said reverse drive and said carrier normally retaining said respective reverse drive in retaining engagement with respective reverse drive forked members and normally retaining said members in reverse drive receiving condition, said release lever being responsive to engagement with the next adjacent drapery hanger to pivot out of retaining engagement position with said respective reverse drive releasing said reverse drive from the retention position with said respective reverse drive forked members and releasing said forked members from reverse drive condition.

6. An improved drapery hanger and manipulator as defined in claim 5 wherein said carrier forward drive receiving means comprises a drive plate located on each of said carriers in the path of said forward drive means and having respectively progressively smaller openings therethrough in the forward direction of movement whereby forward movement of said line through said openings will cause said progressively larger annular projections of said drive to sequentially and respectively engage said drive plates at the openings thereof similarly sequentially and respectively drive said carriers forwardly.

7. An improved drapery hanger and manipulator as defined in claim 5 wherein said carrier reverse drive receiving means comprises a series of reverse drive forked members respectively mounted on said carriers and movably to position the tines thereof into the path of said annular lateral drive members normally receiving reverse drive therefrom, and a series of reverse drive blocks respectively slidably mounted in said carriers and releasably biased into engagement with respective ones of said reverse drive forked members in the reverse path of said drive normally releasably retaining said drive blocks against said respective forked projections releasably normally retaining said reverse drive forked members in reverse drive receiving position, whereby said forked members are normally biased into the reverse path of said annular drive projections to releasably receive reverse drive engagement therefrom.

8. An improved drapery hanger and manipulator as defined in claim 7 wherein said carrier forward drive receiving means comprises a drive plate located on each of said carriers in the path of said forward drive means and having respectively progressively smaller openings therethrough in the forward direction of said movement whereby forward movement of drive means through said openings will cause said progressively larger annular projections of said drive sequentially and respectively engaging said drive plates at the openings thereof to similarly sequentially and respectively drive said carriers forwardly.

9. An improved drapery hanger and manipulator as defined in claim 3 wherein said reverse drive disengaging release means comprises a release lever respectively pivotally mounted on respective carriers on the reverse side thereof and in the path of the respective next adjacent drapery hanger, said release lever having a locking bar portion pivotally biased into the reverse path of said respective reverse drive block of said respective carriers normally precluding reverse relative movement between said reverse drive block and said carrier normally retaining said respective reverse drive blocks in retaining engagement with said respective reverse drive forked members and normally retaining said members in reverse drive receiving condition, said release lever having a release bar portion respective to engagement with the next rearwardly adjacent drapery hanger when said hanger is fixed against rearward motion in the path of the carrier thereof to pivot said locking bar out of retaining engagement position with said respective reverse drive blocks and releasing said reverse drive block from the retention position with said respective reverse drive forked members releasing said forked members from reverse drive condition.

10. An improved drapery hanger and manipulator as defined in claim 9 wherein said release lever locking bar portion is normally biased into a position between the respective carrier drive block of the carrier thereof and the pivot of said lever to releasably lock said respective drive block against rearward movement within the carrier thereof.

11. An improved drapery hanger and manipulator as defined in claim 5 wherein said release lever portion is normally positioned in the rearward path of the carrier thereof and pivotally rearwardly spaced from said carrier for pivotal release movement toward the rear of said carrier pivotally releasing lever.

12. An improved drapery hanger and manipulator as defined in claim 10 wherein said release lever bar portion is normally positioned in the rearward path of said carrier thereof and pivotally rearwardly spaced from said carrier for pivotally release movement toward the rear of said carrier and to pivotally release said release lever bar portion.

13. An improved drapery hanger and manipulator as defined in claim 1 wherein said bridge track has a release actuator stop in the longitudinal reverse path of said hook hangers engaging the rearmost hook hanger means at a predetermined rearmost position along said bridge track when said rearmost hook hanger means is moved to said rearmost position, said carriers have a release actuator stop means on the forward end thereof in the longitudinal reverse path of the next forwardly adjacent hook hanger means engaging the next forwardly adjacent hook hanger means, said drapery hook hanger means has a body portion having a certain longitudinal length and a release actuator link slidably mounted to said body portion in the longitudinal bridge track path of said drapery hook hanger means with respective limited longitudinal forward and rearward movement parallel to said bridge track beyond the forward and rearward extremities of said drapery hook hanger body portion to respectively forwardly engage said release actuator link of the next adjacent drapery hook hanger or said reverse drive disengaging means of said carrier whereby as said carriers are moved to the respective farthest rearward position in said bridge track said bridge release actuator stop and said carrier release stops will respectively engage the release actuator link of the next adjacent rearmost one of said hook hanger release actuator links and serially move each next forwardly adjacent release actuator link forwardly relative to respective drapery hanger hook body means thereof for engaging said reverse drive disengaging means of respective carriers in said longitudinal track path positively releasing said respective next forward carrier.

14. An improved drapery hanger and manipulator as defined in claim 4 wherein said bridge has a release actuator stop means in the longitudinal reverse path of said hook hangers for engaging the rearmost hook hanger means at a predetermined rearmost position along said bridge track when said rearmost hook hanger means is moved to said rearmost position, said carriers have a release actuator stop means on the forward end thereof in the longitudinal reverse path of the next forwardly adjacent hook hanger means and adapted for engaging the next forwardly adjacent hook hanger means, said drapery hook hanger means has a body portion having a certain longitudinal length and a release actuator link slidably mounted to said body portion in the longitudinal bridge track path of said drapery hook hanger means for respective limited longitudinal forward and rearward movement parallel to said bridge track beyond the forward and rearward extremities of said drapery hook hanger body portion and adapted to respectively forwardly engage said release actuator link of the next adjacent drapery hook hanger or said reverse drive disengaging means of said carriers whereby as said carriers are moved to the respective farthest rearward position in said bridge track said bridge release actuator stop and said carrier release stops will respectively engage the release actuator link of the next adjacent rearmost one of said hook hanger release actuator links to serially move each next forwardly adjacent release actuator link forwardly relative to respective drapery hanger hook body means thereof to engage said reverse drive disengaging means of respective carriers in said longitudinal track path to positively release said respective next forward carrier.

15. An improved drapery hanger and manipulator as defined in claim 8 wherein said bridge has a release actuator stop means in the longitudinal reverse path of said hook hangers for engaging the rearmost hook hanger means at a predetermined rearmost position along said bridge track when said rearmost hook hanger means is moved to said rearmost position, said carriers have a release actuator stop means on the forward end thereof in the longitudinal reverse path of the next forwardly adjacent hook hanger means and adapted for engaging the next forwardly adjacent hook hanger means, said drapery hook hanger means has a body portion having a certain longitudinal length and a release actuator link slidably mounted to said body portion in the longitudinal bridge track path of said drapery hook hanger means for respective limited longitudinal forward and rearward movement parallel to said bridge track beyond the forward and rearward extremities of said drapery hook hanger body portion and adapted to respectively forwardly engage said release actuator link of the next adjacent drapery hook hanger or said reverse drive disengaging means of said carriers whereby as said carriers are moved to the respective farthest rearward position in said bridge track said bridge release actuator stop and said carrier release stops will respectively engage the release actuator link of the next adjacent rearmost one of said hook hanger release actuator links to serially move each next forwardly adjacent release actuator link forwardly relative to respective drapery hanger hook body means thereof to engage said reverse drive disengaging means of respective carriers in said longitudinal track path to positively release said respective next forward carrier.

16. An improved drapery hanger and manipulator as defined in claim 12 wherein said bridge has a release actuator stop means in the longitudinal reverse path of said hook hangers for engaging the rearmost hook hanger means at a predetermined rearmost position along said bridge track when said rearmost hook hanger means is moved to said rearmost position, said carriers have a release actuator stop means on the forward end thereof in the longitudinal reverse path of the next forwardly adjacent hook hanger means and adapted for engaging the next forwardly adjacent hook hanger means, said drapery hook hanger means has a body portion having a certain longitudinal length and a release actuator link slidably mounted to said body portion in the longitudinal bridge track path of said drapery hook hanger means for respective limited longitudinal forward and rearward movement parallel to said bridge track beyond the forward and rearward extremities of said drapery hook hanger body portion and adapted to respectively forwardly engage said release actuator link of the next adjacent drapery hook hanger or said reverse drive disengaging means of said carriers whereby as said carriers are moved to the respective farthest rearward position in said bridge track said bridge release actuator stop and said carrier release stops will respectively engage the release actuator link of the next adjacent rearmost one of said hook hanger release actuator links to serially move each next forwardly adjacent release actuator link forwardly relative to respective drapery hanger hook body means thereof to engage said reverse drive disengaging means of respective carriers in said longitudinal track path to positively release said respective next forward carrier.

* * * * *

UNITED STATES PATENT AND TRADEMARK OFFICE

CERTIFICATE OF CORRECTION

PATENT NO. : 4,881,588

DATED : November 21, 1989

INVENTOR(S) : HAROLD L. MADSEN

It is certified that error appears in the above-identified patent and that said Letters Patent is hereby corrected as shown below:

| | | |
|---|---|---|
| Column 10 | Line 60 | "movably" should be --movable--; |
| Column 11 | Line 40 | "movably" should be --movable--; |
| Column 12 | Line 11 | "respective" should be --responsive--; |
| Column 12 | Line 37 | "pivotally" should be --pivotal--; and |
| Column 12 | Line 61 | "carrier" should be --carriers--. |

Signed and Sealed this

Twentieth Day of November, 1990

*Attest:*

HARRY F. MANBECK, JR.

*Attesting Officer*

*Commissioner of Patents and Trademarks*